US010196775B2

(12) United States Patent
D'Agnone

(10) Patent No.: US 10,196,775 B2
(45) Date of Patent: Feb. 5, 2019

(54) METHOD FOR PROCESSING GRASS FOR MANUFACTURING PAPER, PAPERBOARD AND CARDBOARD

(71) Applicant: Uwe D'Agnone, Hennef (DE)

(72) Inventor: Uwe D'Agnone, Hennef (DE)

( * ) Notice: Subject to any disclaimer, the term of this patent is extended or adjusted under 35 U.S.C. 154(b) by 201 days.

(21) Appl. No.: 15/113,811

(22) PCT Filed: Dec. 17, 2014

(86) PCT No.: PCT/EP2014/078190
§ 371 (c)(1),
(2) Date: Jul. 22, 2016

(87) PCT Pub. No.: WO2015/091627
PCT Pub. Date: Jun. 25, 2015

(65) Prior Publication Data

US 2017/0022662 A1 Jan. 26, 2017

(30) Foreign Application Priority Data

Dec. 18, 2013 (DE) ..... 10 2013 114 386

(51) Int. Cl.

| | |
|---|---|
| ***D21B 1/06*** | (2006.01) |
| ***D21D 1/34*** | (2006.01) |
| ***D21D 1/32*** | (2006.01) |
| ***D21D 1/02*** | (2006.01) |
| ***D21D 1/20*** | (2006.01) |

(52) U.S. Cl.
CPC ..... *D21B 1/06* (2013.01); *D21D 1/02* (2013.01); *D21D 1/20* (2013.01); *D21D 1/32* (2013.01); *D21D 1/34* (2013.01)

(58) Field of Classification Search
CPC ..... D21B 1/00–1/068
USPC ..... 162/1–100
See application file for complete search history.

(56) References Cited

U.S. PATENT DOCUMENTS

| | | | | |
|---|---|---|---|---|
| 3,392,004 A * | 7/1968 | Chari | D21C 11/122 | 162/30.1 |
| 3,508,713 A * | 4/1970 | Huppke | B02C 18/141 | 241/188.1 |
| 4,451,331 A * | 5/1984 | Raggam | B30B 9/04 | 162/18 |
| 6,017,475 A * | 1/2000 | Cantrell | B09B 3/00 | 162/4 |
| 8,637,284 B2 * | 1/2014 | Medoff | A61K 8/97 | 435/171 |
| 2006/0201641 A1 * | 9/2006 | Harris | D21C 11/125 | 162/37 |

(Continued)

FOREIGN PATENT DOCUMENTS

WO WO2013135632 * 9/2013 ..... D21H 11/12

*Primary Examiner* — Nahida Sultana
(74) *Attorney, Agent, or Firm* — Douglas Denninger

(57) ABSTRACT

The present invention relates to a method for processing grass or hay as paper pulp having the steps of pre-reducing the grass or hay with a bale breaker and/or a shredder to an average fiber length between 500 mm and 10 mm, preferably between 120 mm and 10 mm, removing impurities and foreign or extraneous substances by means of a cyclone; reducing and fibrillating the grass or hay in a fiber mill, fraying the grass or hay; and screening and/or sifting the grass or hay by means of a circulating-air separator and/or a cyclone screener.

19 Claims, 6 Drawing Sheets

(56) References Cited

U.S. PATENT DOCUMENTS

| | | | | |
|---|---|---|---|---|
| 2010/0112242 | A1* | 5/2010 | Medoff | C08H 8/00 428/22 |
| 2011/0111456 | A1* | 5/2011 | Medoff | B01J 19/085 435/68.1 |
| 2013/0178561 | A1* | 7/2013 | Carrubba | B29B 9/06 524/15 |
| 2014/0120596 | A1* | 5/2014 | Wang | C12P 7/14 435/162 |
| 2015/0068693 | A1* | 3/2015 | D'Agnone | D21H 11/12 162/5 |

* cited by examiner

METHOD FOR PROCESSING GRASS FOR MANUFACTURING PAPER, PAPERBOARD AND CARDBOARD

CROSS-REFERENCE TO RELATED APPLICATIONS

This application is a national phase filing under 35 USC § 371 of international application No. PCT/EP2014/078190 filed 17 Dec. 2014, which claims priority to German Application No. 10 2013 114386.5 filed 18 Dec. 2013. The entire contents of each of the above-mentioned applications are incorporated herein by reference.

FIELD OF THE INVENTION

The present invention relates to a method for processing grass or hay for use as a substitute pulp, preferably in the paper industry.

BACKGROUND OF THE INVENTION

Methods for processing hay or grass for use in the paper industry are known. In these methods, grass, among other materials, is used as a filler for making paper. For this purpose, the grass is dried and reduced to smaller pieces to such an extent that it essentially does not contribute to strength during sheet formation, but, as an economical organic filler, positively affects both the surface characteristics and opacity, i.e. the light-tightness of the paper sheet.

The field of paper manufacturing covers a wide spectrum and includes, among other areas, the following:

- Very fine papers in the field of toilet paper with grammages of 17 grams per square meter ($g/m^2$);
- Graphic papers with grammages of 60 to 350 $g/m^2$ for the production of brochures, for example;
- Brown paper types with grammages of 120 to 600 $g/m^2$ for producing cartons and packaging;
- Heavy, single-ply paperboards with grammages of 500 to 1400 $g/m^2$.

The raw material used in manufacturing paper is mostly cellulose, scrap paper or also a combination thereof (ground wood pulp is still used in small quantities).

SUMMARY OF THE INVENTION

Based on these available pulps, it is desirable to be able to use additional pulp in manufacturing paper. In this context, grass or hay could contribute as a third raw material. Grass has all of the basic properties that are necessary for cellulose production and thus paper production. In addition to the use of raw materials, the widest variety of materials is added, depending on the requirements of the paper and the manufacturing method.

For grass or hay to be established as an additional raw material, it must be ensured that the requirements for the raw material for manufacturing the particular type of paper are satisfied and that a quality standard is effectively ensured.

In addition, processing hay or grass in the paper industry is relatively difficult, since the raw material is available only seasonally and its quality characteristics can fluctuate widely, especially in terms of composition and dryness.

Based on the prior art, the present invention seeks to solve the problem of furnishing a pulp for paper, paperboard and/or cardboard production that remedies at least some of the disadvantages known from the prior art.

This problem is solved by a method for processing grass or hay having the steps including: a) Pre-reducing the grass or hay with a bale breaker and/or a shredder to an average fiber length between 500 mm and 10 mm; b) Removing impurities and foreign or extraneous substances by a cyclone; c) Reducing and fibrillating the grass or hay in a fiber mill; d) After milling, pulling apart and/or isolating fibers of the grass or hay with shape rollers; and e) Screening and/or sifting the grass or hay by a circulating-air separator and/or a cyclone screener. Preferred embodiments of the present invention are the subject matter of the dependent claims.

The method for processing grass or hay according to the invention has at least the following steps:

a) Pre-reducing the grass or hay with a bale breaker and/or a shredder to an average fiber length between 500 mm and 10 mm, preferably between 120 mm and 10 mm;
b) Removing impurities and foreign matter or impurities by means of a cyclone;
c) Reducing and fibrillating the grass or hay in a fiber mill;
d) Pulling apart the grass or hay;
e) Screening and/or sifting the grass or hay by means of a circulating-air separator and/or a cyclone screener.

According to a preferred embodiment, pre-reduction is accomplished by a bale breaker and/or shredder. In this process, the pre-reduction can be carried out in a so-called grinding vat, for example, the hay or grass preferably being reduced to an average length between 120 mm and 10 mm. This reduction is more preferably accomplished by cutting the fibers to the desired average length, for example with a blade rotor.

For improved processing of the grass or hay, the typical cut length of the grass or hay at harvest should preferably measure no more than 120 mm to 100 mm, and the moisture content of the hay during processing should be between 0% and 15%. Moisture content between 8% and 10% is especially preferable. The hay should also be free of mold and mold spores.

According to the present invention, the grass is furnished by cutting and harvesting meadow grass, athletic fields and/or lawns, where, in the case of meadows in particular, the second or later cutting is especially well-suited, since the tendency for tangling is reduced in these cuttings. However, it also lies within the scope of the present invention to subject sweet grass and/or sedge from the first cutting to further processing, which can increase the expenditure on cutting and/or grinding. In addition, this type of grass has a higher protein content, thus making it preferred feed for animals. Furnishing grass, or, as the case may be, in its dried form as hay, is a normal part of modern agriculture. After being cut and dried, the grass is pressed into various sized bales and stored dry.

According to the invention, the removal of impurities and foreign or extraneous substances is accomplished by means of a cyclone, within which impurities and foreign objects such as earth, sand and stones, metal objects, plastic parts and sheeting, wood, glass and fine dust are removed. In addition to the removal of solids, dust is removed by means of filters from the conveying air in this method step, the solid material (dust) captured therein being returned to the hay, i.e. the accepted stock.

Following the removal of impurities and foreign or extraneous substances, the pulp is fed to a fiber mill for reduction and fibrillation, preferably by means of pneumatic conveying equipment. At this juncture, the reduction and fibrillation of the grass or hay is preferably carried out in a hammer mill for coarse fiber lengths, in an edge mill for medium fiber lengths and/or in a fine grinding mill for short fiber lengths. According to the present invention, coarse fiber lengths have an average fiber length between 10 mm and 3 mm, medium fiber lengths an average fiber length between 3 mm and 0.5 mm and short fiber lengths an average fiber length under 0.5 mm.

In a further preferred embodiment, the edge mill has at least one, preferably three, rollers, which continuously grind the pulp against a die, in particular a perforated die. Furthermore, the different milling machines also employ different dies or screens with which the fiber length can also be affected.

The pulp ground in this manner is then pulled apart, so that the compacting of the pulp that results from grinding is undone and the fibers are separated as much as possible. This step is necessary to allow the pulp to be screened or sifted in the following step, since separation into different fiber lengths would not otherwise be possible. In this process, the pulling apart and/or separating of the fibers following grinding is preferably accomplished by means of profile rollers. For this purpose, a roller mill, for example, having two oppositely positioned profile rollers is used, the pulp being fed through the roll gap thereof and the compacted pulp clumps being separated into individual fibers.

Following the fraying of the grass or hay, the pulp can be separated into at least three fractions having different fiber lengths by means of a circulating air separator and/or a cyclone screener by screening and/or by sifting the grass or hay, where the coarse fraction has an average fiber length between 10 and mm and 3 mm, the medium fraction an average fiber length between 3 mm and 0.5 mm and the short fraction an average fiber length of less than 0.5 mm.

According to an alternative embodiment of the present invention, following the removal of impurities, before being subjected to further reduction into smaller pieces or grinding, the shredded and cleaned grass or hay is temporarily stored in a storage container. Such a storage container, for example, can have a capacity of multiple cubic meters and can provide, among other functions, buffering and continuous supply of the grinding stage. The pulp can moreover be removed from the storage container by means of a screw conveyor, the pulp being transported, preferably following the removal of the pulp by means of a pneumatic conveying device.

According to another especially preferred embodiment of the present invention, the precut and cleaned grass or hay is fed by means of a material-metering screw to the hammer mill, edge mill and/or fine grinding mill. When selecting the grinding machine, such as hammer mill, edge mill and/or fine grinding mill, it must additionally be taken into consideration that these not only shorten fiber length, but also increase the surface of the grass or hay fibers to the extent that provides improved strength potential. This increase in fiber surface is also achieved in particular by means of defibrillating grinding by the grinding machine specified above.

According to another particularly preferred embodiment of the invention, after the grass or hay has been screened and/or sifted, the pulp or the grass or hay is pelleted by means of a pellet press. In this process, only the accepted stock is pelleted following sifting and/or screening and, if necessary, a predefined coarse fraction is removed and packed, preferably in a separate filling unit.

Following the screening and/or sifting of the grass or hay, the accepted stock and/or rejected stock is transported by means of a conveying screw and/or mixing screw. At this juncture following screening and/or sifting and before pelleting, it is also possible that different fiber length fractions, in particular coarse, medium and/or short fiber lengths of the grass or hay are mixed in predefined proportions.

According to another preferred embodiment of the invention, the grass or hay is moistened by means of a water-dosing system to achieve good compacting of the pulp pellet to be produced. The pellets are additionally produced using a pellet press in which the pulp is pressed by a die to produce the pellets via at least one edge roller, in particular a perforated die. The basic shape of the pellets is preferably cylindrical, with a diameter measuring roughly between 40 mm and 2 mm, preferably between 20 mm and 3 mm, in particular between 10 mm and 4 mm, preferably around 8 mm or 4 mm. The correspondingly formed pellets are then conveyed out of the pellet press by means of a rotary feeder and packed at a dispensing station, preferably into large bags.

Because processing grass or hay generates a considerable amount of dust, the method for preparing grass or hay is executed by means of a device that is explosion-proof, particularly with respect to the generation of dust.

In addition to the method described above for preparing grass or hay, the present invention encompasses the use of the corresponding pulp for producing paper, paperboard and/or cardboard.

The invention is explained below using an exemplary example, it being understood that the invention covers modifications and/or enhancements obvious to a person skilled in the art. Furthermore, as the preferred exemplary embodiments do not constitute a limitation of the invention, modifications and enhancements also fall under the scope of the present invention.

BRIEF DESCRIPTION OF THE DRAWINGS

In what follows, preferred embodiments of the invention are explained in more detail with reference to the drawings, in which.

DETAILED DESCRIPTION OF THE PRESENTLY PREFERRED EMBODIMENTS

In the process of prior studies, in particular conventional hay from an agricultural operation was used and processed into grass pellets with a machine suited for the production of wood pellets. In this process, it was not possible to clean the hay, and the cut was limited to 6 mm. In addition, the various requirements in paper production were analyzed, thereby allowing the requirements for grass or hay fibers to be defined. In other words, different properties of grass or hay fibers must be achieved in the production process depending on paper type (paperboard, graphic paper or toilet paper).

Basically, these properties concern:

Eliminating impurities and foreign objects and ensuring a defined degree of purity Eliminating fine dust to reduce the portions that act as filler in paper and thus change the technical characteristics Cutting/shredding the stalks to the particular length required according to the requirements of paper production Grinding the stalks to increase the surface structure of the fibers according to the requirements of paper production Ensuring fiber length distribution within a defined fraction.

Ensuring a consistent quality standard.

Additional goals that should be achieved during production include, among others:

Compressing into pellets for simpler storage,

Dispensing into paper bags, big bags or a silo for ease of feeding into the paper production process and Reducing volume to reduce the cost of transport.

From this it is clear that the basic principles for the method of preparing grass or hay for use in paper, paperboard or cardboard production are the end user's requirements for the end product, i.e. paper. In this context, the initial situation is additionally determined by the quality and the condition of the hay being prepared.

If, for example, the paper needs to be highly tear-resistant, a certain minimum fiber length must be maintained to make optimal use of the strength potential of the pulp. Different properties of the grass or hay pulp can be achieved by appropriate method steps.

Figure 1:
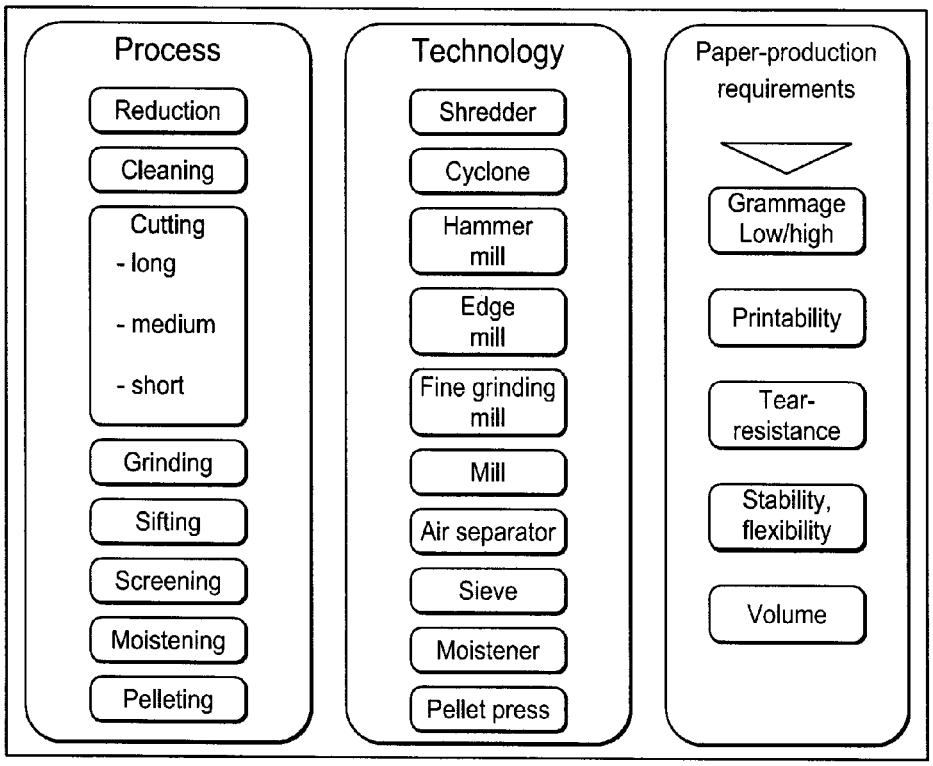
FIG. 1 is a schematic diagram illustrating possible method steps for preparing grass or hay according to the present invention.

In this context, in the three columns, FIG. 1 shows the procedure or technique to be used for preparing grass or hay while factoring in the key paper-production requirement parameters for the pulp to be used.

Grass is a raw material that is available in large quantities and, above all, locally. Grass grows quickly and in central Europe can thus be harvested in two to five annual cuttings.

The method comprises the processing steps such as shredding, cleaning, cutting, grinding, screening, sifting, moistening and pelleting. It is not mandatory to employ all method steps in the processing of the pulp. Moreover, it is also possible to combine the individual method steps with one another in different ways. In addition, it is also possible to adapt, within the individual process steps, the target variables according to the profile of paper production requirements. For example, the pulp can be cut long, medium or short during the cutting process, or it can be further shortened or fibrillated during grinding. The two method steps of cutting and grinding differ fundamentally from one another such that the quality of the pulp to be achieved can be affected across a wide range.

Equipment for executing the aforementioned method steps includes, among other items, shredders, cyclones, hammer mills, edge mills, fine grinding mills, air separators, screens, moisteners and pellet presses.

Paper-production requirements depend essentially on the particular use of the paper. In this regard, distinction is made among the following core requirements:

Grammage/weight per $m^2$

Increases strength and opacity

Volume

For making a stronger material/thicker paper

Tear-resistance

Important for papers subject to great stress and wear

Stability, flexural strength

Important for making cardboard boxes and packaging

Printability

Requires a smooth surface

These requirements should also be assured with the method for preparing grass or hay and can be achieved as detailed below:

Grammage/weight per unit area

The natural property of grass or hay results in higher volume. If necessary, the weight/grammage can be reduced, while other properties remain the same. Opacity increases as grass or hay content increases all the way to "opaque".

Low surface weight thus requires a very homogenous distribution of fibers, for which the pulp must also have enough short fibers in addition to long fibers to achieve the desired pulp distribution and homogeneity in the paper.

Volume

In addition to the natural property, volume is achieved by increasing the surface structure, i.e. by grinding the grasses.

Tear-resistance

Tear-resistance is a function of fiber length and/or fiber length distribution. The fiber length (mm) is achieved by cutting in the corresponding mill.

Depending on the mill or on the combination of multiple mills employed, grass fibers of short, medium or long length are produced.

If the proportion of a certain fiber length and thereby the tear-resistance of the paper is to be as high as possible, this can be achieved by subsequent sifting or removal of the fine substance.

The tear-resistance of the paper is substantially determined by the average length of the grass or hay fibers, which, in addition to the actual length, is critical for the strengthening surface. This surface is affected not only by the actual length of the fibers when cut, but also by grinding. Fibrillating can thus considerably increase the binding-active surface of the fibers. This is achieved essentially by "exposing" the binding-active fibers from the outer area of the fiber lattice.

Stability, flexural strength

The required stability or flexural strength is achieved through the appropriate fiber length and surface structure of the grass or hay fibers.

Printability

Printability requires a smooth surface that is free of unevenness. To this end, a good cleaning process and fibers that are as short and uniform as possible are imperative. The uniform fibers are obtained by using an air separator followed by sifting.

When it comes to printability, the paper surface is especially critical. Considering the printing process, it must be as smooth and even as possible to facilitate optimally even ink trapping and color distribution, thereby making it possible to produce an appealing printed image. In addition, there may also be special requirements for the bonding of fibers in the surface to prevent fibers from separating and thereby contaminating the printing machine.

Figure 2:
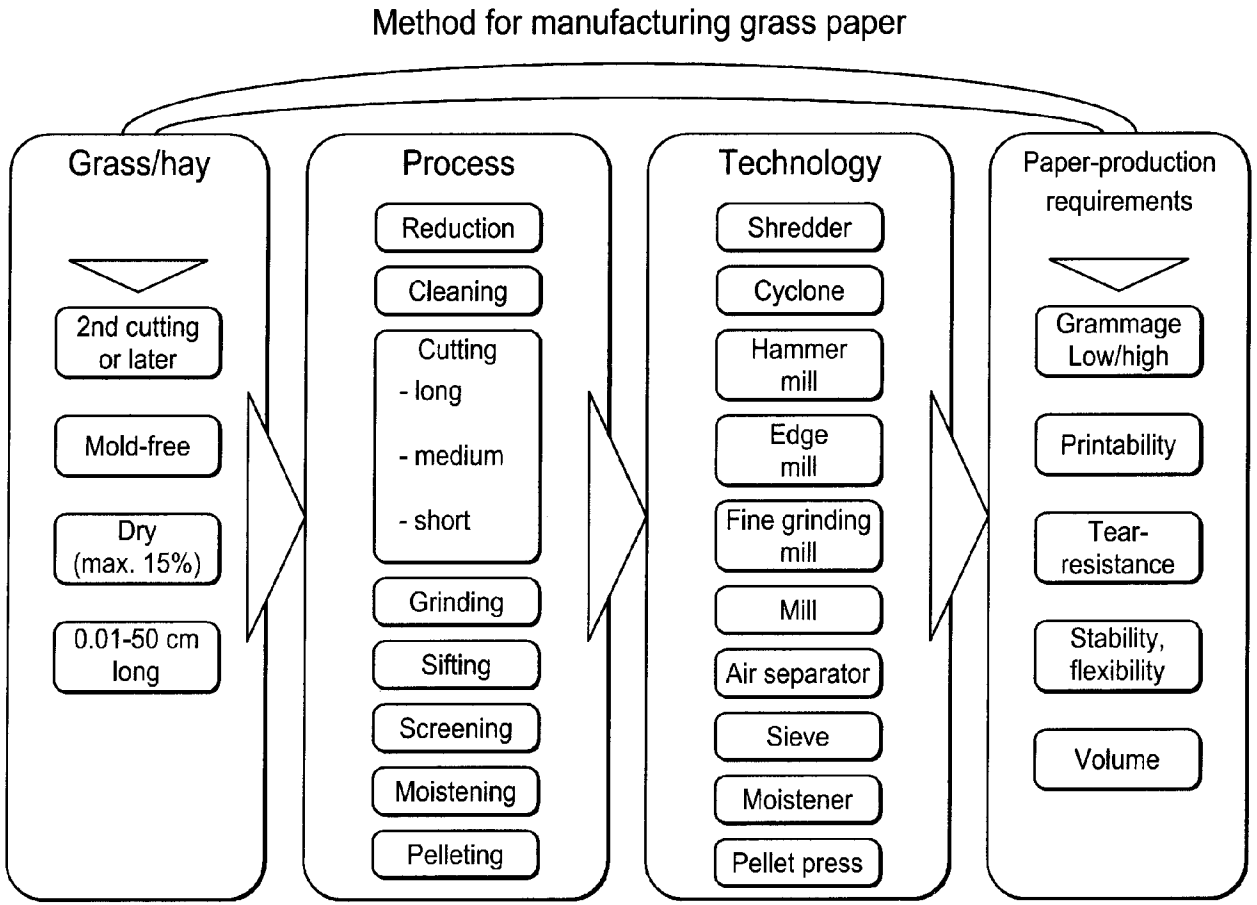
FIG. 2 shows the diagram of FIG. 1 with additional requirements for the grass or hay at the time of harvesting.

FIG. 2 shows the chart from FIG. 1 with the addition of the starting raw material components, i.e. grass or hay. From this figure it is clear that, because of the seasonally dictated composition and structure of the grass, it is preferable to use grass from the second cutting and later cuttings of the annual harvest that is free of mold, has no more than 15% residual moisture and has a cut length typical of harvesting that measures between 0.1 mm and 500 mm, for example.

As stated in the description above, this grass or hay is supplied to the method for processing grass or hay for the paper-manufacturing process.

A possible configuration of a plant set-up to produce approximately 2 metric tons of grass or hay per hour is described below in the context of a diagram showing the sequence of operation.

1. Breaking up the hay bales using a bale breaker and shredder in a grinding vat to a length between 1 and 12 cm for a first pre-reduction. This plant is configured for an output of approximately 4 metric tons of grass per hour.
2. Feeding into a cyclone to remove impurities and foreign or extraneous materials such as:
   Earth, sand and stones
   Metal objects
   Plastic parts and sheeting
   Wood
   Glass
   Fine dust In addition to removing solids, dust is removed by a filter from the conveying air. The solids (dust) captured therein are returned to the hay in the supply container, if necessary.
3. Capturing the cleaned hay in a supply container with a capacity of approximately 2.5 $m^3$ for buffering and continuously supplying the mill and, if necessary, moistening if moisture content is below 8%.
4. Feeding to the mill by means of a pneumatic conveying device.
5. Conveying to the reduction process by means of
   a hammer mill for a coarse fiber length
   an edge mill for a medium fiber length
   a fine grinding mill for a short fiber length Fiber length is determined by the use of various dies or screens.
6. Conveying to the grinding process
   Grinding is carried out either during the reduction process or, if necessary, in an additional milling process.
   The particular degree of grinding determines the corresponding enlargement of the surface structure.
7. Conveying to the air separation process
   Different fractions with different grain size distribution are achieved through air separation. Any remaining foreign objects are separated by screening.
8. Conveying to the sifting process
   Further refinement of the fraction with primarily homogenous grain sizes is achieved by sifting.
9. Conveying to the pelleting process
   Pressing the grass fibers into grass pellets.
   Moisturizing is necessary if moisture is below 8%.
   To prevent mold and ensure shelf-life, a moisture content of 15% must not be exceeded.
   Pellet strength is determined by the use of various dies and the pressure generated in the press. The lower the strength, the more easily it dissolves during paper production.
10. Conveying to the filling process, e.g.
    into paper bags,
    into big bags or
    into a silo Experimental Design To better illustrate the invention, tests designed according to the invention are described below.

General Description of the Tests

In all of the tests described here, hay was used that had been delivered in the form of two bundled hay bales. This starting material contains long-fiber hay, i.e. having a fiber length between 50 and 80 mm, with dried hay fibers, a raw product moisture of 9.3% and a bulk density of 0.07 kg/$dm^3$. The flow behavior can be characterized as slow flowing.

The goal of the test was to produce fibers of even length using the edge mill. The ground hay is intended to be later mixed into the paper.

The test results show that the hay was processed very well with the 33-390 press. The 33-390 press was used as an edge mill for reducing the hay. The hay was broken up very evenly in sub-test P4.

Sub-Test P1

Sub-test P1 was performed using a 33-390 press at a roller number of 2, a rotational speed of 166 rpm and a roller speed of 2.28 m/s. An 82112 die having a press ratio of 1:20 was used. The conveyor belt was fed by shovels after the material had been spread out on the factory floor. Before pressing, the material had a moisture content of 9.3%, a temperature of 20° C. and a bulk density of 0.07 kg/$dm^3$. Following pressing, the material had a moisture content of 10.0%, a temperature of 59° C. and a bulk density of 0.37 kg/$dm^3$. The press was operated at an output of 180 kg/h. No cooling was undertaken.

In this sub-test P1, there was fluctuating press capacity (13 and 24 kW) due to intermittent ejection of material through the pockets of the conveyor belt, choppy press operation, some loosely pelleted and unstable pellets and a somewhat unevenly milled product. The material was ejected into a big bag.

Sub-test A2

Sub-test A2 was performed using a press having the parameters: roller diameter 400 mm, fluting 475 flutes/circumference=3.8 F/cm=9.6 F/inch, level 0.1 mm, back angle 41.5°, cutting angle 12.5°, flute depth 1.1 mm, roller speed (left) 8.9 m/s, roller speed (right) 6.4 m/s, lead of 1:1.4, gap 3.4 mm. The press was fed manually.

Figure 3:
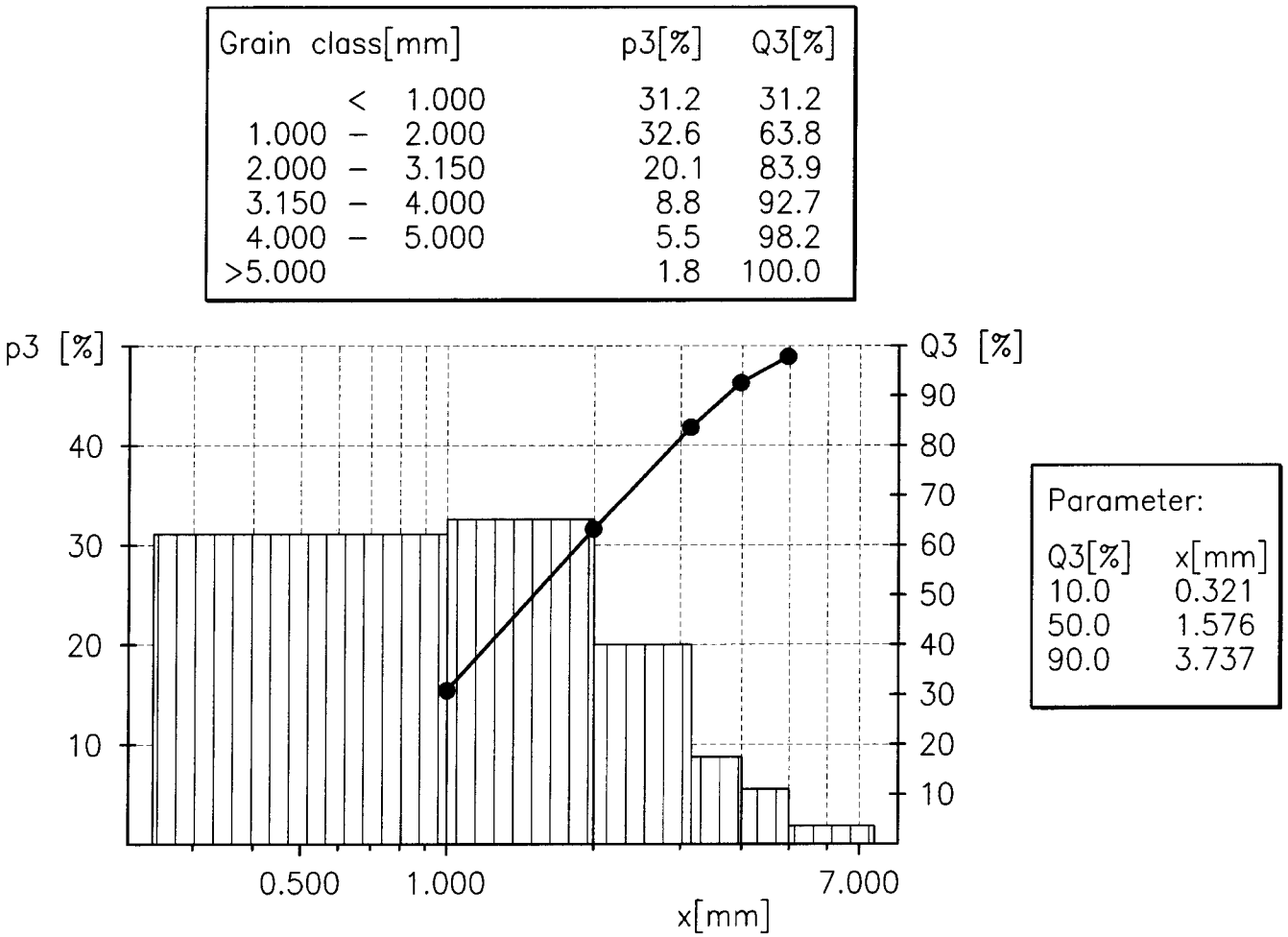
FIG. 3 shows the sieve analysis of the end product of Sub-test A2.

FIG. 3 shows the sieve analysis of the end product. Grain classes are as follows: below 1 mm 31.2%, the range between 1 to 2 mm 32.6%, for the range between 2 to 3.15 mm 20.1%, for the range between 3.15 to 4.0 mm 8.8%, for the range between 4 to 5 mm 5.5% and above 5 mm 1.8%. The aggregate grain classes are as follows: below 1 mm 31.2%, up to 2 mm 63.8%, up to 3.15 mm 83.9%, up to 4.0 mm 92.7% up to 5.0 mm 98.2% and total 100%.

Sub-Test A3

Compared to sub-test A2, sub-test A3 was performed with a smaller gap of 0.8 mm (as opposed to 3.4 for A2). All other parameters were the same as those used for sub-test A2.

Figure 4:
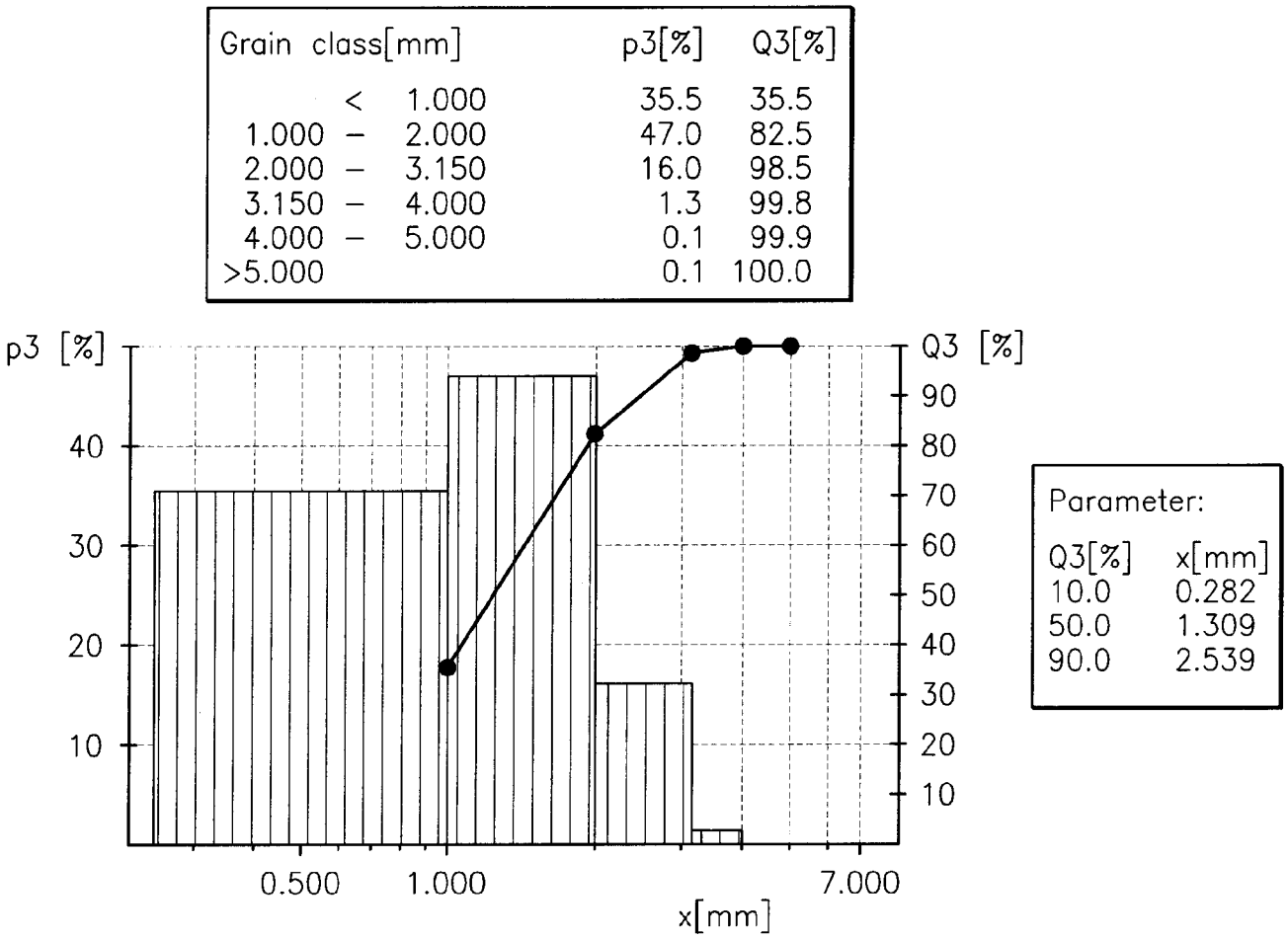
FIG. 4 shows the sieve analysis of the end product of Sub-test A3.

FIG. 4 shows the sieve analysis of the end product. Grain classes were as follows: below 1 mm 35.5%, for the range between 1 to 2 mm 47.0%, for the range between 2 to 3.15 mm 16.0%, for the range between 3.15 to 4.0 mm 1.3%, for the range between 4 to 5 mm 0.1% and above 5 mm 0.1%. The aggregate grain classes are as follows: below 1 mm 35.5%, up to 2 mm 82.5%, up to 3.15 mm 98.5%, up to 4.0 mm 99.8% up to 5.0 mm 99.9% and total 100%.

Sub-Test P4

Sub-test P4 was performed with the same press used for P1.

As with P1, the conveyor belt was loaded by shovel. A smaller bore diameter than that of sub-test P1 was used.

Before pressing, as was the case with P1, the material had a moisture content of 9.3%, a temperature of 20° C. and a bulk density of 0.07 kg/$dm^3$. Following pressing, the material had a moisture content of 7.7%, a temperature of 47° C.

and a bulk density of 0.26 kg/dm$^3$. In this sub-trial P4, there was fluctuating press performance (6 and 18 kW) due to the intermittent material ejection through the pockets of the conveyor belt, choppy press operation, some loosely pelleted and unstable pellets, but a very evenly milled product. The material was once again ejected into a big bag.

Figure 5:
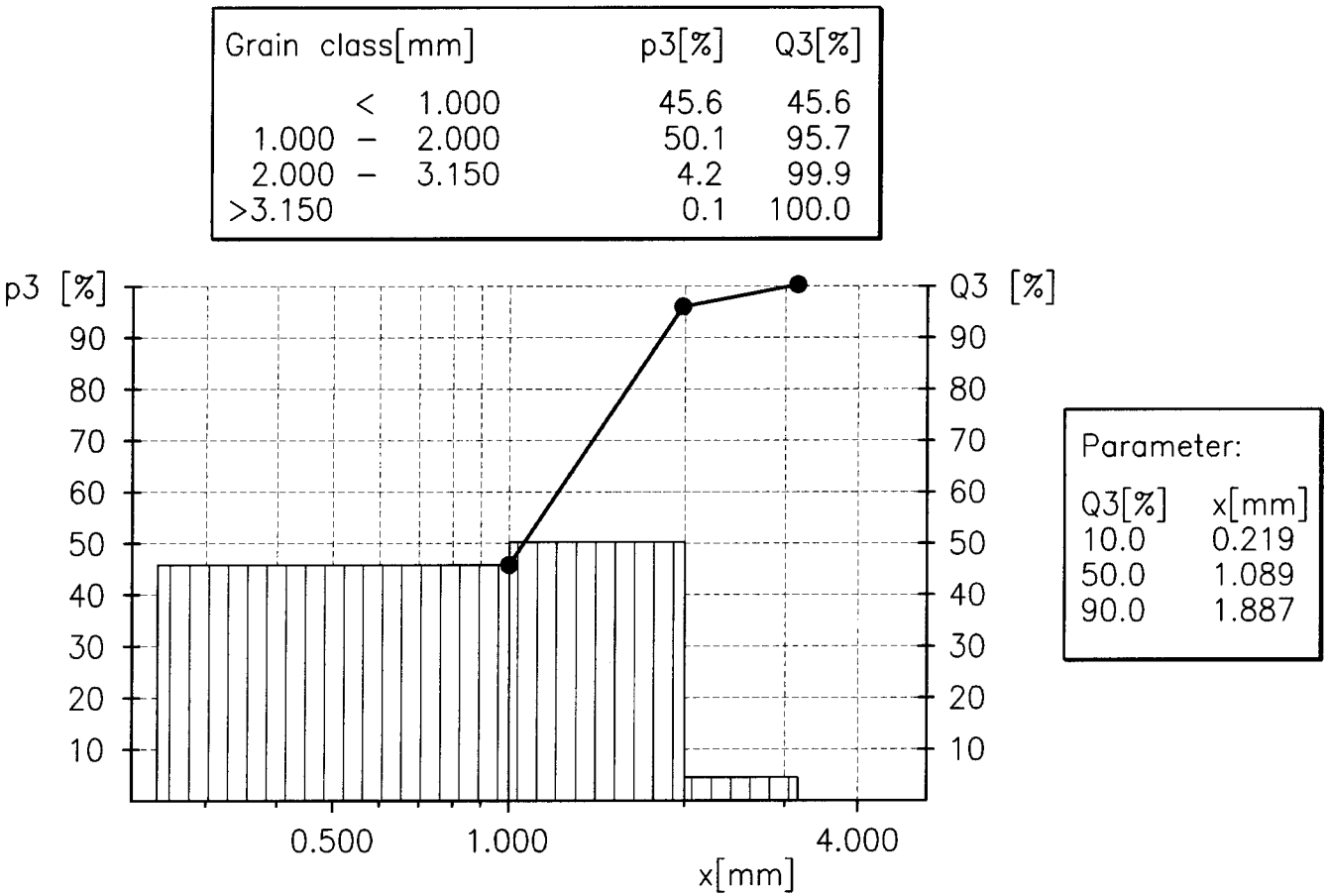
FIG. 5 shows the light fraction of Sub-test P4.
Figure 6:
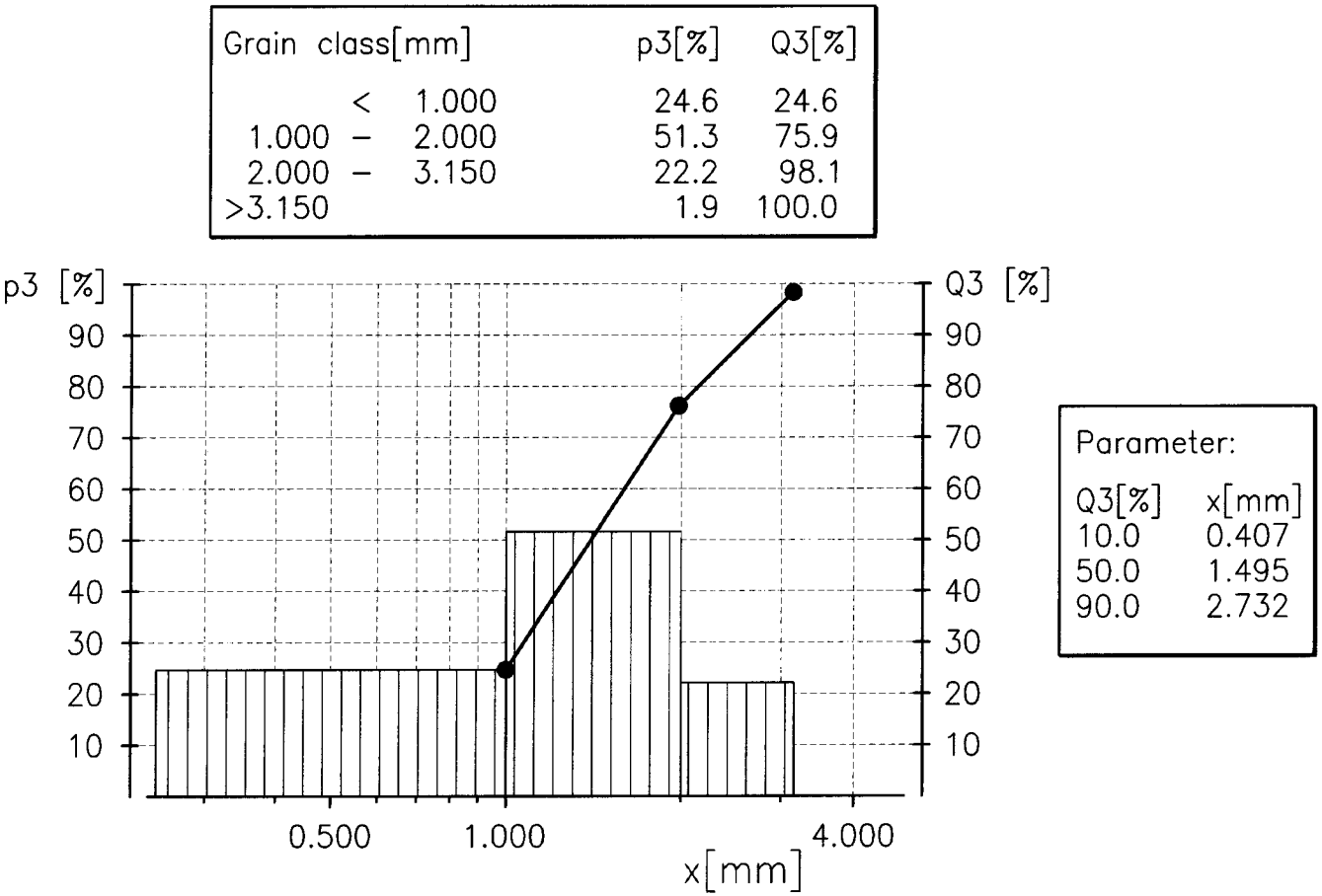
FIG. 6 shows the medium fraction of Sub-test P4.

The subsequent screening yielded two fractions, the grain class distribution of which is shown in FIG. 5 as the light fraction and in FIG. 6 as the medium fraction. For the medium fraction, the grain classes are as follows: below 1 mm 24.6%, for the range between 1 and 2 mm 51.3%, for the range between 2 and 3.15 mm 22% and above 3.15 mm 1.9%. The aggregate grain classes are as follows: below 1 mm 24.6%, up to 2 mm 75.9%, up to 3.15 mm 98.1% and total 100%.

For the light fraction, the grain classes are as follows: below 1 mm 45.6%, for the range between 1 and 2 mm 50.1%, for the range between 2 and 3.15 mm 4.2% and above 3.15 mm 0.1%. The aggregate grain classes are as follows: below 1 mm 45.6%, up to 2 mm 95.7%, up to 3.15 mm 99.9% and total 100%.

In summary, the present results establish that a larger die results in longer fibers and lower homogeneity of the grain classes. Reduction with the roller mill is advantageous for separating into different fractions. A smaller die reduces fiber length, results in homogeneous fractions and requires, as the case may be, no reduction by the roller mill.

The invention claimed is:

1. A method for processing grass or hay having the steps comprising:

a) Pre-reducing the grass or hay with a bale breaker and/or a shredder to an average fiber length between 500 mm and 10 mm;

b) Removing impurities and foreign or extraneous substances by a cyclone;

c) Reducing and fibrillating the grass or hay in a fiber mill;

d) After milling, pulling apart and/or isolating fibers of the grass or hay with shape rollers; and e) Screening and/or sifting the grass or hay by a circulating-air separator and/or a cyclone screener.

2. The method for processing grass or hay according to claim 1, wherein pelleting is performed by a pellet press after the grass or hay has been screened and/or sifted.

3. The method for processing grass or hay according to claim 1, wherein the reduction and fibrillation of the grass or hay is accomplished in a hammer mill for coarse fiber lengths, in an edge mill for medium fiber lengths and/or in a fine grinding mill for short fiber lengths.

4. The method for processing grass or hay according to claim 1, wherein following the removal of impurities, the shredded and cleaned grass or hay is temporarily stored in a storage container before being subjected to further reduction or grinding.

5. The method for processing grass or hay according to claim 1, wherein coarse fiber lengths have an average fiber length between 10 mm and 3 mm, medium fiber lengths have an average fiber length between 3 mm and 0.5 mm and short fiber lengths have an average fiber length under 0.5 mm.

6. The method for processing grass or hay according to claim 1, wherein the bale breaker is a container having a blade rotor.

7. The method for processing grass or hay according to claim 3, wherein the precut and cleaned grass or hay is fed to the hammer mill, edge mill and/or fine grinding mill by a material-metering screw.

8. The method for processing grass or hay according to claim 3, wherein the edge mill has at least one roller which continuously grind the pulp against a die.

9. The method for processing grass or hay according to claim 1, wherein following the screening and/or sifting of the grass or hay, a predefined fraction is removed and packed away in a filling unit.

10. The method for processing grass or hay according to claim 1, wherein the grass or hay is separated into at least three fiber length fractions by screening and/or sifting, wherein the coarse fraction has an average fiber length between 10 and mm and 3 mm, the medium fraction an average fiber length between 3 mm and 0.5 mm and the short fraction an average fiber length below 0.5 mm.

11. The method for processing grass or hay according to claim 2, wherein following the screening and/or sifting of the grass or hay, accepted stock is transported by a conveying screw and/or mixing screw for pelleting.

12. The method for processing grass or hay according to claim 2, wherein different fiber length fractions, in particular coarse, medium and/or short fiber lengths of the grass or hay are mixed in predefined portions following screening and/or sifting and before pelleting.

13. The method for processing grass or hay according to claim 2, wherein the grass or hay is moistened by a water-dosing system prior to pelleting.

14. The method for processing grass or hay according to claim 2, wherein to produce the pellets, the pellet press presses the pulp through a die, in particular a perforated die, by at least one edge roller.

15. The method for processing grass or hay according to claim 14, wherein the basic shape of the pellets is cylindrical, with a diameter measuring roughly between 40 mm and 2 mm.

16. The method for processing grass or hay according to claim 2, wherein the pellets are conveyed out of the pellet press by a rotary feeder.

17. The method for processing grass or hay according to claim 2, wherein the pellets are packed at a dispensing station.

18. The method for processing grass or hay according to claim 1, wherein the device is explosion-proof, at least with respect to dust.

19. The method for processing grass or hay according to claim 1, wherein the hay has a moisture content between 0% and 15%.

* * * * *